US009540902B2

(12) United States Patent
Ingraham et al.

(10) Patent No.: US 9,540,902 B2
(45) Date of Patent: Jan. 10, 2017

(54) RETRIEVABLE CEMENTING BUSHING SYSTEM

(71) Applicant: Schlumberger Technology Corporation, Sugar Land, TX (US)

(72) Inventors: Derek Ingraham, Sugar Land, TX (US); James Hall, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/717,609

(22) Filed: May 20, 2015

(65) Prior Publication Data

US 2015/0252648 A1 Sep. 10, 2015

Related U.S. Application Data

(63) Continuation of application No. 13/429,535, filed on Mar. 26, 2012, now Pat. No. 9,062,520.

(51) Int. Cl.

| | |
|---|---|
| ***E21B 23/01*** | (2006.01) |
| ***E21B 33/129*** | (2006.01) |
| ***E21B 33/12*** | (2006.01) |
| ***E21B 33/13*** | (2006.01) |

(52) U.S. Cl.

CPC ..... *E21B 33/1293* (2013.01); *E21B 23/01* (2013.01); *E21B 33/12* (2013.01); *E21B 33/13* (2013.01)

(58) Field of Classification Search

CPC ..... E21B 33/12; E21B 33/128; E21B 23/00; E21B 23/01; E21B 23/03

USPC .... 166/381, 382, 123, 125, 181, 174, 255.2, 166/242.7

See application file for complete search history.

(56) References Cited

U.S. PATENT DOCUMENTS

| | | | |
|---|---|---|---|
| 4,281,711 | A | 8/1981 | Braddick et al. |
| 4,562,889 | A | 1/1986 | Braddick |
| 4,690,220 | A | 9/1987 | Braddick |
| 5,472,055 | A | 12/1995 | Simpson et al. |
| 5,884,702 | A | 3/1999 | Yokley et al. |
| 6,009,943 | A | 1/2000 | Yokley et al. |
| 6,378,610 | B2 | 4/2002 | Rayssiguier et al. |
| 6,695,060 | B1 | 2/2004 | Guidry |
| 6,739,398 | B1 | 5/2004 | Yokley et al. |
| 7,373,988 | B2 | 5/2008 | Campbell et al. |
| 7,581,596 | B2 | 9/2009 | Reimert |
| 7,686,090 | B2 | 3/2010 | Reimert |
| 2005/0051342 | A1 | 3/2005 | Campbell |
| 2007/0251704 | A1 | 11/2007 | Reimert |

OTHER PUBLICATIONS

International Search Report and Written Opinion issued for International Patent Application No. PCT/US2013/026992, mailed on Jun. 4, 2013, 13 pages.

*Primary Examiner* — Robert E Fuller
*Assistant Examiner* — Steven MacDonald
(74) *Attorney, Agent, or Firm* — Michael Stonebrook

(57) ABSTRACT

A technique facilitates downhole service operations including cementing operations. A retrievable cementing bushing is designed to facilitate the service operation and includes a body on which is mounted an engagement lug. The engagement lug is mounted for movement in a radial direction and includes an outer engagement feature and an inner engagement feature. The inner engagement feature is oriented for cooperation with a slick joint. The engagement lug is biased in a radially outward direction for engagement with corresponding features of a surrounding wall.

16 Claims, 6 Drawing Sheets

RETRIEVABLE CEMENTING BUSHING SYSTEM

CROSS-REFERENCE TO RELATED APPLICATIONS

This application is a continuation of U.S. patent application Ser. No. 13/429,535, filed Mar. 26, 2012, which is incorporated herein by reference in its entirety.

BACKGROUND

Hydrocarbon fluids such as oil and natural gas are obtained from a subterranean geologic formation, referred to as reservoir, by drilling a well that penetrates the hydrocarbon-bearing formation. In a variety of downhole applications, casing and/or liners are deployed down along the wellbore and cemented into place. A setting tool string is deployed down through the liners with an appropriate service tool to facilitate the desired service operations, e.g. cementing of the liner or liners within the wellbore. In some applications, the tool string comprises a retrievable cementing bushing which provides a seal against pressure and prevents cement from backing up through an interior of the liner hanger.

SUMMARY

In general, the present disclosure provides a system and method for facilitating a downhole service operation, such as a cementing operation. A retrievable cementing bushing (RCB) is designed to facilitate the service operation and includes a body on which is mounted an engagement lug. The engagement lug is movably mounted for movement in a radial direction and includes an outer engagement feature and an inner engagement feature, e.g. engagement shoulder. The inner engagement feature is oriented for cooperation with a slick joint. The engagement lug is biased in a radially outward direction for engagement with corresponding features of a surrounding wall, e.g. a surrounding packer body wall.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
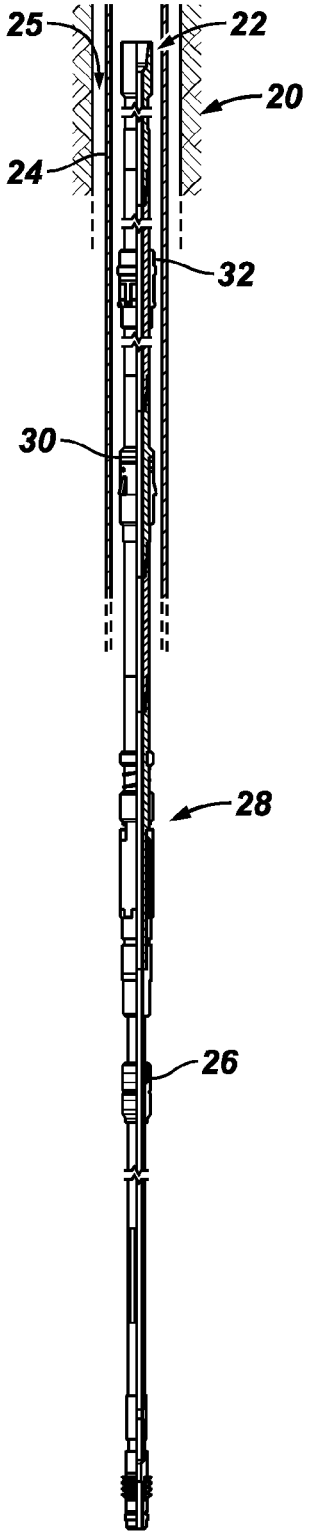
FIG. 1 is an illustration of an embodiment of a well system having a tool string with an RCB, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to performing service operations in a borehole. By way of example, the system and methodology may be used to facilitate cementing operations in wellbores. In this latter example, a tool string is delivered downhole within a surrounding well system, such as a surrounding liner system. The tool string may comprise a variety of components, including a retrievable cementing bushing (RCB). In cementing operations, the RCB provides a seal within the surrounding well system and serves to hold against pressure and to prevent cement slurry from backing up through an interior of the liner hanger. The RCB thus helps force the cement slurry into the annulus surrounding the liner system to facilitate cementing of the liner. However, the RCB can be used with a variety of tool strings and within many types of surrounding well systems depending on the parameters of a given well servicing application.

According to an embodiment of the disclosure, the RCB is resettable in a manner that allows it to be automatically set at a desired location and then reset if prematurely removed from the desired location. By way of example, the RCB may comprise a bushing body on which is mounted a radially movable engagement lug. The engagement lug comprises engagement features by which it engages corresponding features in the surrounding well system when delivered down through the well system via the tool string. The engagement lug maybe a single lug or a plurality of lugs that are spring biased in the radially outward direction. Radially movable refers to the capacity for outward or inward movement of the engagement lug relative to a longitudinal axis of the RCB. The actual path along which the engagement lug moves may be along a path perpendicular to the axis of the RCB or along a different path, e.g. an arcuate path, resulting in movement in the radial direction.

In some applications, the engagement lug also may comprise a radially inward feature designed for engagement with an internal slick joint which may be moved through an internal longitudinal passage of the RCB. The radially inward feature extends inwardly and provides a shoulder or other type of feature to engage a corresponding shoulder or feature of the slick joint. However, once the RCB is moved to the desired location and the engagement lug is moved radially outward into engagement with the corresponding features of the surrounding well system, the slick joint may pass through the RCB unobstructed. If the RCB and the engagement lug are inadvertently pulled from the desired location and from engagement with the corresponding features, the slick joint may again be moved into abutting engagement with the radially inward feature of the engagement lug. This allows the slick joint to be used in moving the RCB back to the desired location for automatic resetting at the desired location.

Referring generally to FIG. 1 a well system is illustrated as comprising a tool string carrying an RCB. The well system can be used in a variety of well applications, including onshore applications and offshore applications. In this example, the tool string is deployed in a surrounding tubular well system, such as a liner system. However, the tool string and the RCB may be used in a variety of other tubular systems and other applications.

In the example illustrated, an overall well system 20 is illustrated as comprising a tool string 22 deployed into a surrounding tubular system 24 positioned within a wellbore 25. By way of example, the tubular system 24 may comprise a liner system. In this embodiment, the tool string 22 comprises a variety of components, including a retrievable cementing bushing (RCB) 26. Depending on the application, the tool string 22 may comprise other types of components, such as a hydraulic running tool 28, an internal packer 30, and a junk bonnet 32. The various components may be connected together by a variety of subs and/or other components depending on the parameters of a given well servicing application. In the example illustrated, the RCB 26 is designed to form a seal within tubular system 24, e.g. within a liner system.

Figure 2:
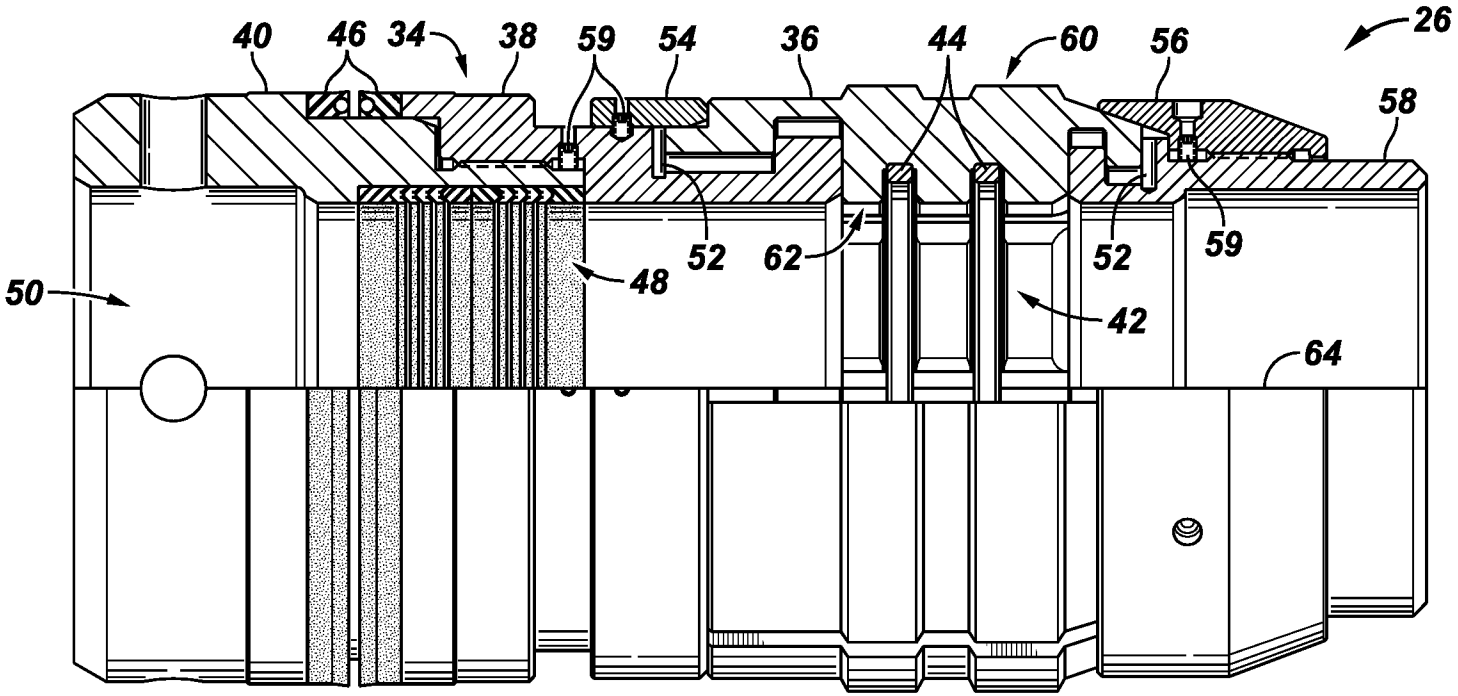
FIG. 2 is a partial cross-sectional view of an example of an RCB, according to an embodiment of the disclosure.

Referring generally to FIG. 2, an example of the RCB 26 is illustrated. In this embodiment, the RCB 26 comprises a body 34 to which an engagement lug 36 is movably mounted. The engagement lug 36 may be mounted for radial movement between a radially inward or retracted position and a radially extended position, as illustrated. The path of radial movement may be straight, angular, and/or curved depending on the design of body 34 and engagement lug 36. In the embodiment illustrated, engagement lug 36 is mounted to a center body portion 38 which is designed to guide the engagement lug 36 when moving in the radial direction. However, body 34 may comprise other components, such as a top adapter 40. The engagement lug 36 may be formed as an individual lug or as a plurality of lugs separately mounted for movement in a radial direction. In FIG. 2, the engagement lug 36 is illustrated as a plurality of engagement lugs positioned circumferentially around body 34.

In the embodiment of FIG. 2, the engagement lug 36 is biased to move in a radially outward direction. By way of example, the engagement lug 36 may be biased via a spring member 42 although other biasing mechanisms, e.g. pressurized fluid, also may be used to bias the engagement lug 36 outwardly. Spring member 42 may comprise a variety of springs, such as a C-spring 44. In the embodiment illustrated, a plurality of C-springs, e.g. two C-springs, is employed and disposed within internal recesses formed along an interior surface of the engagement lug 36.

The RCB 26 also may comprise a variety of other components to facilitate cementing or other servicing operations. For example, the RCB 26 may comprise an outer seal or seals 46 designed to form a seal between the RCB 26 and a surrounding well system surface. An internal seal or seals 48 may be located along an internal, longitudinal passage 50 extending through the RCB 26. The internal seal 46 is positioned to form a seal between the RCB 26 and an internal slick joint slidably received along the longitudinal passage 48, as described in greater detail below.

Depending on the overall design of RCB 26, a variety of other features may be employed. For example, the engagement lug 36 may be slidably mounted between pins 52. Additionally, the movable engagement lug 36 may be retained by a top ring 54 and a bottom ring 56. The bottom ring 56 is secured to a nose member 58 which also may be designed to guide the engagement lug 36 when moved along its radially oriented path between retracted and extended positions. Various fasteners, such as set screws 59, may be used to secure center body portion 38 to top adapter 40, top ring 54 to center body portion 38, and bottom ring 56 to nose member 58. However, the type, number and design of the various components used to form RCB 26 may be adjusted according to a given application.

The embodiment illustrated in FIG. 2 utilizes an outer engagement feature 60 located on a radially outer surface of the engagement lug 36. The radially outward engagement feature 60 is designed to engage a corresponding feature of the surrounding tubular system 24. Spring member 42 biases engagement lug 36 in the radially outward direction and moves lug 36 radially outward once outer engagement feature 60 is translated into position at the corresponding engagement feature. Additionally, the engagement lug 36 may comprise an inner engagement feature 62 located on a radially inward surface of the engagement lug 36 for exposure to longitudinal passage 50. By way of example, the radially inward engagement feature 62 may comprise a shoulder, e.g. a sharp edged shoulder having an engagement surface oriented approximately perpendicular to a longitudinal axis 64 of RCB 26. The engagement feature 62 is designed to abut a corresponding engagement feature of a slick joint, as described in greater detail below.

Figure 3:
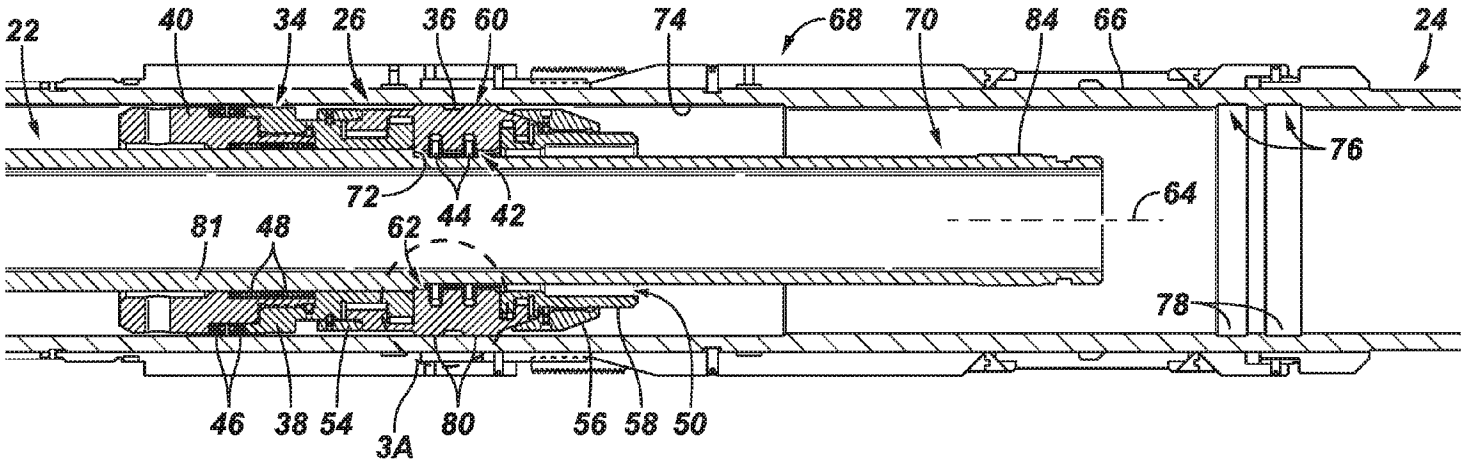
FIG. 3 is an illustration of an example of an RCB disposed within a tubular well system, e.g. liner system, according to an embodiment of the disclosure.

In FIG. 3, the RCB 26 is illustrated in an operational example in which the RCB 26 is disposed within tubular system 24. In this example, the RCB 26 is illustrated as moving along the interior of a packer body 66 of a packer 68. The packer 68 can be part of tubular system 24 which may be in the form of a liner system. For example, packer 68 may be positioned in liner system 24 above a liner hanger or other component of the liner system 24.

A slick joint 70 is illustrated as slidably positioned through RCB 26 along the internal, longitudinal passage 50. The slick joint 70 comprises an external engagement feature 72 designed to engage the inner engagement feature 62 of the engagement lug 36. By way of example, external engagement feature 72 may comprise a shoulder, such as a sharp edged shoulder designed to abut inner engagement feature 62 along a surface oriented generally perpendicular to axis 64 of RCB 26 and slick joint 70.

Figure 3A:
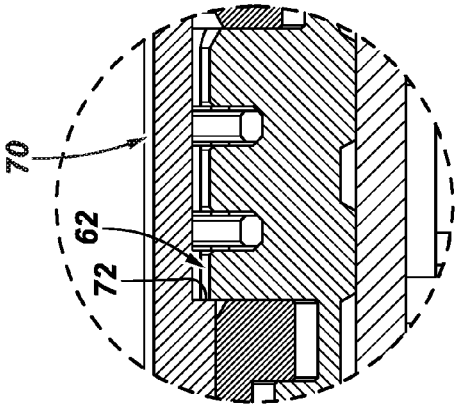
FIG. 3A shows detail of a portion of the RCB disposed within a tubular well system illustrated FIG. 3.

As illustrated in FIG. 3, the outer engagement feature 60 of engagement lug 36 slides along an internal surface 74 of the tubular system 24 prior to reaching a corresponding engagement feature 76. In the example illustrated, corresponding engagement feature 76 is disposed along internal surface 74 of packer body 66. Although the corresponding engagement feature 76 may be structured in a variety of forms, the illustrated example shows a plurality of annular recesses 78 designed to receive a plurality of annular extensions 80 which may be used to form outer engagement feature 60 of engagement lug 36. It should be noted the RCB 26 can be used in other locations, e.g. in other subs along the well system, and is not limited to being used within the packer body 66. As illustrated, the engagement lug 36 is held radially inward at a radially retracted position as it slides along internal surface 74. When in this radially retracted position, engagement feature 62 extends a sufficient distance into longitudinal passage 50 to enable secure engagement with external engagement feature 72 of the slick joint 70, as shown in FIG. 3A. Accordingly, the slick joint 70 may be used to move the RCB 26 along the interior of tubular system 24 at least until engagement lug 36 is received in engagement feature 76, as illustrated in FIG. 4.

Figure 4:
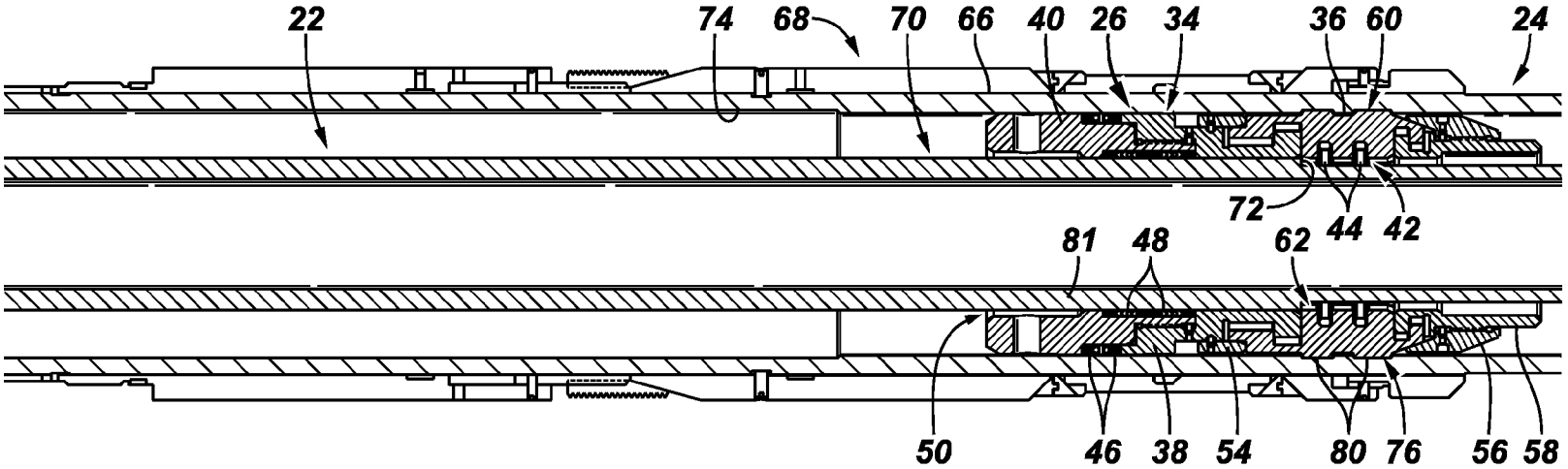
FIG. 4 is an illustration similar to FIG. 3 but showing the RCB at a different position within the tubular well system, according to an embodiment of the disclosure.
Figure 5:
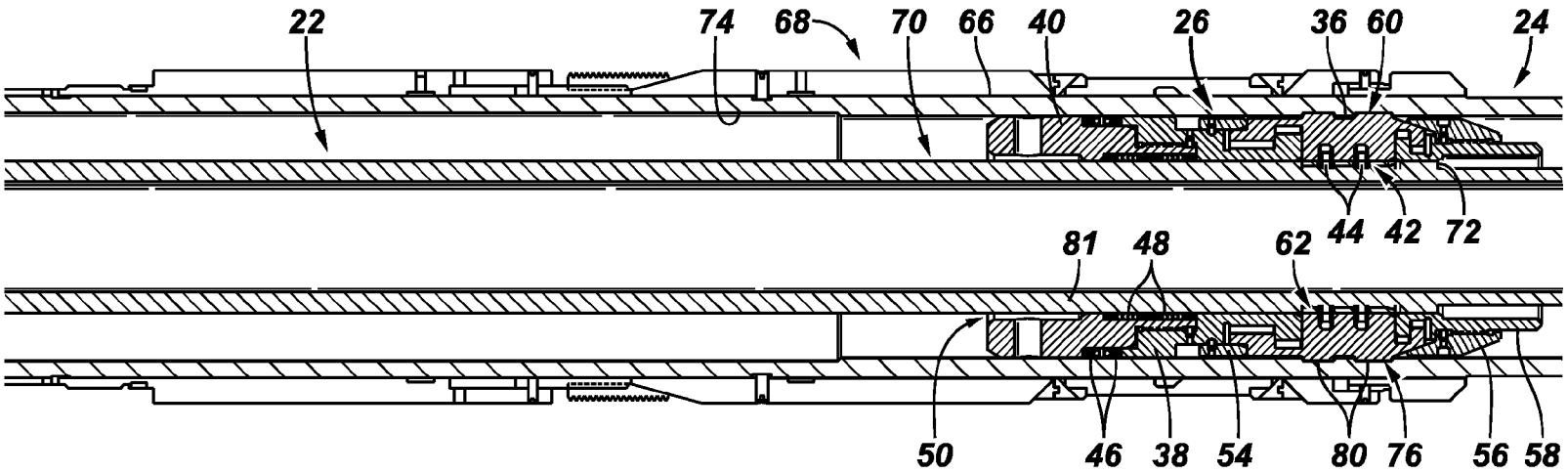
FIG. 5 is an illustration similar to FIG. 4 but showing a slick joint at a different position within the RCB, according to an embodiment of the disclosure.

Referring generally to FIG. 4, once the engagement lug 36 reaches engagement feature 76, spring member 42 forces the engagement lug 36 to a radially extended position. For example, spring member 42 moves the engagement lug 36 in a radially outward direction to engage the outer engagement feature 60 with the corresponding engagement feature 76 of the tubular system 24. When the engagement lug 36 is forced radially outward into engagement with the corresponding engagement feature 76, the inner engagement feature 62 also moves radially outward to allow passage of the slick joint engagement feature 72, as illustrated in FIG. 5. In this latter operational position, the RCB 26 is locked in place at the desired location within tubular system 24 by a larger diameter portion 81 of slick joint 70. In the position illustrated in FIG. 5, the larger diameter portion 81 prevents movement of engagement lug 36 in a radially inward direction. While RCB 26 is locked at the desired location, slick joint 70 may be selectively moved along the internal, longitudinal passage 50 to facilitate performance of the desired servicing operation, e.g. cementing operation.

Figure 6:
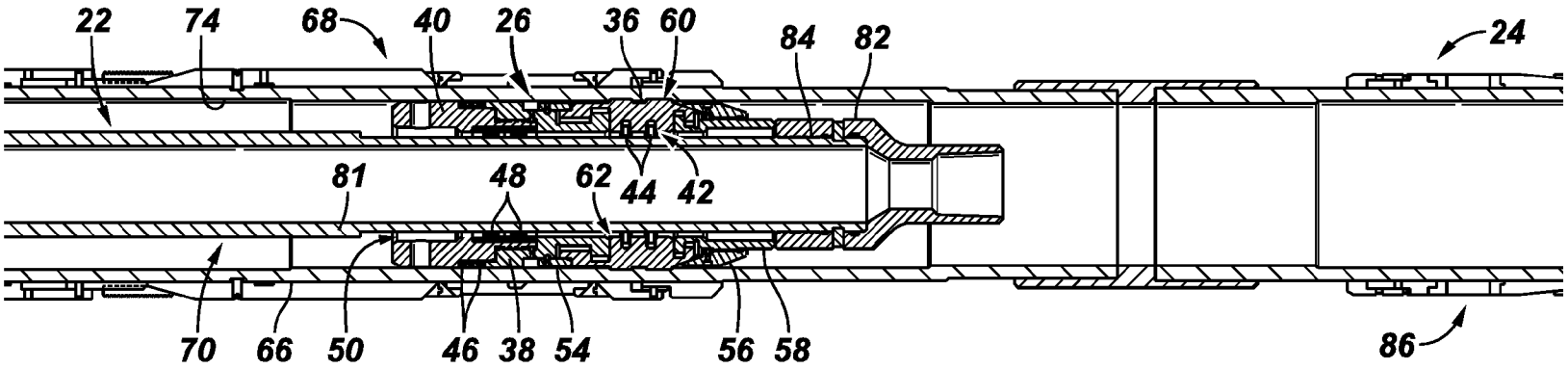
FIG. 6 is an illustration similar to FIG. 4 but showing the slick joint at a different position within the RCB, according to an embodiment of the disclosure.

Upon completion of the servicing operation or during a transition between stages of the servicing operation, the RCB 26 may be retrieved or moved back along the tubular system 24 via a retrieval device 82, as illustrated in FIG. 6. The retrieval device 82 may be attached to a distal end 84 of slick joint 70. In this example, picking up of the slick joint 70 causes slick joint engagement feature 72 to move back past inner engagement feature 62 of engagement lug 36 which serves to unlock the engagement lug 36. This allows retrieval device 82 to apply force against the RCB 26 during continued lifting of slick joint 70 so as to force engagement lug 36 to its radially retracted position. Once engagement lug 36 is in its radially retracted position, the RCB 26 may be slid along internal surface 74.

In the event that retrievable cementing RCB 26 is inadvertently moved away from engagement feature 76, the features of RCB 26 enable resetting of the RCB 26 at the desired location of engagement feature 76. For example, the continued radially outward bias applied by spring member 42 enables the engagement lug 36 to be moved radially outward once the outer engagement feature 60 is again positioned at the corresponding engagement feature 76. Additionally, the inner engagement feature 62 enables movement of the RCB 26 back to the desired location at engagement feature 76 via engagement with the corresponding engagement feature 72 of slick joint 70. Slick joint 70 may simply be moved back down through tubular system 24 so that the engagement feature 72, e.g. shoulder feature 72, engages RCB 26 via feature 62 to enable movement of the RCB 26 back to its desired location. If necessary, the RCB 26 may be reset in this manner multiple times.

The RCB 26 may be employed in a variety of service applications. By way of example, RCB 26 may be used with tubular system 24 in the form of a liner system to facilitate pressure tests, setting of packers, and other functions during a cementing procedure. In FIG. 6, for example, the RCB 26 is illustrated as designed for engagement within packer 68 which, in turn, is positioned above a liner hanger 86. However, RCB 26 may be used at other locations and within other types of devices.

In the embodiment illustrated, RCB 26 allows the tool string 22 to be stroked for the running of pressure tests and the setting of packers. However, if the RCB 26 is dislodged during these procedures, the slick joint 70 may be used to reset the RCB 26 as described above.

Depending on the downhole application, the embodiments described herein may be used to facilitate cementing operations and/or a variety of other servicing operations. In wellbore related applications, the overall well system may comprise many types of components and arrangements of components. Additionally, the tubular system 24 may be used with a variety of devices and systems, including a variety of packers, subs, flow control devices, sensors and other components designed to facilitate the given servicing operation. The specific components and arrangements of components used to form the RCB also may be constructed in various designs and configurations depending on the parameters of a given well related application or other type of application.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A retrievable cementing bushing comprising:

a body having an internal longitudinal passage;

an engagement lug mounted on the body for movement in a radial direction, the engagement lug having a radially outward engagement feature for engagement with a corresponding feature in a surrounding wall and a radially inward engagement feature for engagement with a slick joint, the engagement lug and the radially inward engagement feature being shiftable to a radially retracted position for engagement with the slick joint;

a spring member positioned to bias the engagement lug in a radially outward direction to move the radially outward engagement feature radially outward into locking engagement with the corresponding feature; and at least one retaining member disposed on an exterior of the body to retain the engagement lug to the body.

2. The bushing as recited in claim 1, wherein the spring member comprises a C-spring disposed along an interior of the engagement lug.

3. The bushing as recited in claim 1, further comprising an outer seal disposed along an exterior of the body.

4. The bushing as recited in claim 3, further comprising an inner seal disposed along an interior of the body.

5. The bushing as recited in claim 1, wherein the radially outward engagement feature of the engagement lug comprises a plurality of annular extensions and the inner engagement feature comprises a sharp edged shoulder.

6. A retrievable cementing bushing comprising:

a body having an internal longitudinal passage for receiving a slick joint;

an engagement lug mounted on the body and biased to move in a radially outward direction, the engagement lug having an internal shoulder oriented for engagement with an external shoulder on the slick joint to facilitate resetting of the retrievable cementing bushing, the engagement lug and the internal shoulder being shiftable to a radially retracted position for engagement with the external shoulder on the slick joint;

a spring member positioned to bias the engagement lug in a radially outward direction to move the radially outward engagement feature radially outward into locking engagement with the corresponding feature; and a retainer member disposed on an exterior of the body to retain the engagement lug to the body.

7. The bushing as recited in claim 6, wherein the spring member comprises a C-spring.

8. The bushing as recited in claim 6 wherein the engagement lug further comprises a radially outward engagement feature oriented for engagement with a corresponding feature of a packer.

9. The bushing as recited in claim 6, wherein the body receives the engagement lug in a manner which allows radially oriented movement of the engagement lug.

10. The bushing as recited in claim 6, wherein the engagement lug is formed as a plurality of engagement lugs which are radially movable.

11. The bushing as recited in claim 6, wherein the engagement lug comprises a radially outward engagement feature oriented for engagement with corresponding features of a surrounding liner system.

12. The bushing as recited in claim 11, wherein the surrounding liner system comprises a packer, and wherein the packer comprises the corresponding features.

13. The bushing as recited in claim 12, wherein the packer comprises a packer body containing the corresponding feature positioned to receive the radially outward engagement feature of the engagement lug.

14. The bushing as recited in claim 6, wherein the engagement lug is slidably mounted between pins.

15. The bushing as recited in claim 6, further comprising a bottom ring, wherein the bottom ring guides the engagement lug when moved between retracted and extended positions.

16. A retrievable cementing bushing comprising:

a body having an internal longitudinal passage for receiving a slick joint;

an engagement lug mounted on the body and biased to move in a radially outward direction, the engagement lug having an internal shoulder oriented for engagement with an external shoulder on the slick joint to facilitate resetting of the retrievable cementing bushing, wherein the engagement lug is slidably mounted between pins, the engagement lug and the internal shoulder being shiftable to a radially retracted position for engagement with the external shoulder on the slick joint; and a spring member positioned to bias the engagement lug in a radially outward direction to move a radially outward engagement feature radially outward into locking engagement with a corresponding feature of a surrounding wall.

* * * * *